US007337942B2

(12) United States Patent
Wang

(10) Patent No.: US 7,337,942 B2
(45) Date of Patent: Mar. 4, 2008

(54) CARTON

(75) Inventor: James J. Wang, Sugar Land, TX (US)

(73) Assignee: The Coca-Cola Company, Atlanta, GA (US)

( * ) Notice: Subject to any disclaimer, the term of this patent is extended or adjusted under 35 U.S.C. 154(b) by 478 days.

(21) Appl. No.: 10/709,774

(22) Filed: May 27, 2004

(65) Prior Publication Data

US 2005/0263578 A1 Dec. 1, 2005

(51) Int. Cl.
*B65D 17/28* (2006.01)

(52) U.S. Cl. ..... 229/242; 206/427; 229/122

(58) Field of Classification Search ..... 229/122, 229/122.1, 240, 242; 206/427; 221/302–305
See application file for complete search history.

(56) References Cited

U.S. PATENT DOCUMENTS

| | | | | |
|---|---|---|---|---|
| 1,541,143 | A | | 6/1925 | Hoile |
| 1,925,102 | A | | 9/1933 | Levkoff |
| 2,115,673 | A | | 4/1938 | Stompe |
| 2,178,301 | A | | 10/1939 | Grant |
| 2,448,819 | A | | 9/1948 | Mitchell |
| 2,723,027 | A | | 11/1955 | Guyer |
| 2,754,047 | A | * | 7/1956 | Schmidt et al. ..... 206/427 |
| 2,842,304 | A | | 7/1958 | Ringler |
| 2,930,516 | A | | 3/1960 | Fowle |
| 2,975,891 | A | | 3/1961 | Stone |
| 3,178,242 | A | | 4/1965 | Ellis |
| 3,228,582 | A | | 1/1966 | Osberg |
| 3,263,861 | A | | 8/1966 | Carr |
| 3,265,283 | A | | 8/1966 | Farquhar |
| RE26,083 | E | | 9/1966 | Forrer |
| 3,300,115 | A | | 1/1967 | Schauer |
| 3,356,279 | A | | 12/1967 | Root |
| 3,517,858 | A | | 6/1970 | Farquhar |
| 3,540,581 | A | | 11/1970 | Koolnis |
| 3,669,251 | A | | 6/1972 | Phillips, Jr. |
| 3,765,327 | A | | 10/1973 | Aronson et al. |
| 3,765,527 | A | | 10/1973 | Vargo |
| 3,894,681 | A | | 7/1975 | Arneson et al. |
| 3,913,739 | A | | 10/1975 | Hennessey |
| 4,000,811 | A | | 1/1977 | Hardison et al. |
| 4,030,596 | A | | 6/1977 | Snyder et al. |
| 4,214,660 | A | | 7/1980 | Hunt, Jr. |
| 4,222,485 | A | | 9/1980 | Focke |
| 4,364,509 | A | | 12/1982 | Holley et al. |

(Continued)

FOREIGN PATENT DOCUMENTS

| | | |
|---|---|---|
| CA | 874828 | 7/1971 |

(Continued)

*Primary Examiner*—Gary E Elkins
(74) *Attorney, Agent, or Firm*—Sutherland Asbill & Brennan LLP

(57) ABSTRACT

A carton for enclosing a number of products. The carton may include a top panel, a first side panel, a second side panel, and a top panel tab positioned adjacent to the top panel and separated by a top panel fold line. The carton may have a first score line extending across the top panel from the first side panel to the second side panel and a pair of second score lines extending across the top panel from the first side panel and the second side panel to the first fold line, thus forming a first and a second corner flap along the top panel.

21 Claims, 3 Drawing Sheets

U.S. PATENT DOCUMENTS

| | | | | |
|---|---|---|---|---|
| 4,375,258 | A | 3/1983 | Crayne et al. | |
| 4,396,143 | A | 8/1983 | Killy | |
| 4,416,410 | A | 11/1983 | Herrmann | |
| 4,417,661 | A | 11/1983 | Roccaforte | |
| 4,560,062 | A | 12/1985 | Valiulis | |
| 4,582,199 | A | 4/1986 | Schuster | |
| 4,584,202 | A * | 4/1986 | Roccaforte | 229/242 |
| 4,726,471 | A | 2/1988 | Whately | |
| 4,974,771 | A | 12/1990 | Lavery | |
| 5,123,589 | A | 6/1992 | Cote | |
| 5,137,211 | A | 8/1992 | Summer et al. | |
| 5,170,934 | A | 12/1992 | Lemoine | |
| 5,279,440 | A | 1/1994 | Fougeres et al. | |
| 5,368,194 | A | 11/1994 | Oliff et al. | |
| 5,465,831 | A | 11/1995 | Smith | |
| 5,520,325 | A * | 5/1996 | Quaintance | 229/240 |
| 5,622,309 | A | 4/1997 | Matsuda et al. | |
| 5,690,230 | A | 11/1997 | Griffith | |
| 5,722,584 | A | 3/1998 | Fujiwara | |
| 5,775,574 | A | 7/1998 | Whitnell | |
| 5,878,947 | A | 3/1999 | Hoy et al. | |
| 6,062,424 | A | 5/2000 | Simile-Gravina et al. | |
| 6,105,854 | A | 8/2000 | Spivey | |
| 6,176,419 | B1 | 1/2001 | Holley, Jr. | 229/122.1 |
| 6,283,293 | B1 | 9/2001 | Lingamfelter | 206/427 |
| 6,478,219 | B1 | 11/2002 | Holley, Jr. | 229/240 |
| 6,484,903 | B2 | 11/2002 | Spivey et al. | 221/303 |
| 6,550,615 | B2 | 4/2003 | Lingamfelter | 206/427 |
| 6,578,736 | B2 | 6/2003 | Spivey | 221/305 |
| 6,715,639 | B2 | 4/2004 | Spivey | 221/305 |
| 6,789,673 | B2 | 9/2004 | Lingamfelter | |
| 6,866,186 | B2 * | 3/2005 | Fogle et al. | 229/242 |
| 7,104,435 | B2 * | 9/2006 | Holley, Jr. | 206/427 |
| 2002/0148887 | A1 * | 10/2002 | Auclair | 229/240 |
| 2002/0185499 | A1 | 12/2002 | Harrelson et al. | 221/305 |
| 2003/0192907 | A1 | 10/2003 | Bates | 221/305 |
| 2003/0234285 | A1 | 12/2003 | Bates et al. | |
| 2004/0040877 | A1 | 3/2004 | Lingamfelter | 206/427 |
| 2004/0089671 | A1 | 5/2004 | Miller | 221/305 |
| 2004/0112948 | A1 * | 6/2004 | Bone | 229/122 |
| 2004/0188509 | A1 | 9/2004 | Holly, Jr. | 229/242 |
| 2005/0056658 | A1 | 3/2005 | Spivey | 221/302 |
| 2005/0085364 | A1 | 4/2005 | Spivey, Sr. | 493/68 |
| 2005/0126947 | A1 * | 6/2005 | Holley, Jr. | 206/427 |

FOREIGN PATENT DOCUMENTS

| | | | | |
|---|---|---|---|---|
| CA | 2246020 | | 2/2000 | |
| DE | 7510538 | U | 8/1975 | |
| DE | 8514718.4 | | 8/1985 | |
| DE | 3612594 | | 10/1987 | |
| DE | 298 16 041 | U1 | 12/1998 | |
| EP | 66029 | A1 * | 8/1982 | 206/427 |
| EP | 0849189 | | 6/1998 | |
| GB | 2186550 | | 8/1987 | |
| JP | 7-9721 | | 2/1995 | |
| WO | WO 96/29260 | | 9/1996 | |
| WO | WO 97-21607 | | 6/1997 | |
| WO | WO 02/102208 | A1 | 12/2002 | |

* cited by examiner

CARTON

BACKGROUND OF INVENTION

The present application relates generally to a carton and more particularly relates to a carton with a dispenser that provides access to the products therein while providing increased structural support to the carton as a whole.

Various types of cardboard cartons are known for enclosing various types of product containers such as cans, bottles, and other objects. One recent type of container is known as the "FRIDGE PACK™" carton. Various types of "FRIDGE PACK™" cartons are produced for and sold to bottlers under license with The Coca-Cola Company of Atlanta, Ga. for the sale of Coca-Cola® brand products.

The "FRIDGE PACK™" cartons generally have a two (2) by six (6) product shape, with two (2) product columns in height and six (6) product rows in length. One end of the carton generally is scored so as to permit the removal of a section of the carton such that the consumer can grasp the products within. The unique design of two (2) columns and six (6) rows with the removable end generally promotes the use of the cartons within a standard refrigerator.

Although the various "FRIDGE PACK™" carton designs are very popular with consumers, certain portions of the dispensing end may be lightly scored, as opposed to completely scored, so as to promote stackability and stability during shipping and warehousing. Such light scoring, however, may make the carton somewhat more difficult to open by the typical consumer.

What may be desired, therefore, is a container with improved stackability. The container also should promote ease of opening while being easy to use, manufacture, and transport.

SUMMARY OF INVENTION

The present invention thus provides a carton for enclosing a number of products. The carton may include a top panel, a first side panel, a second side panel, and a top panel tab positioned adjacent to the top panel and separated by a top panel fold line. The carton may have a first score line extending across the top panel from the first side panel to the second side panel and a pair of second score lines extending across the top panel from the first side panel and the second side panel to the first fold line, thus forming a first and a second corner flap along the top panel.

The top panel tab of the carton may include a pair of top panel tab score lines extending from the pair of second score lines. The top panel and the first side panel may be separated by a first top panel fold line and the top panel and the second side panel may be separated by a second top panel fold line. The first side panel may include a first side panel score line extending from the first score line to the pair of second score lines. The second side panel may include a second side panel score line extending from the first score line to the pair of second score lines. The first side panel score line and the second side panel score line may include a substantially squared "U" shape.

The first side panel may include a first side panel tab and the second side panel may include a second side panel tab. The first side panel tab may include a first side panel tab score line and the second side panel tab may include a second side panel tab score line. The first and the second side panel tab score lines may align with the top panel tab score lines.

The first and the second corner flaps may include a rectangle. The top panel, the first side panel tab, and the second side panel tab may include finger cut outs formed therein.

The present invention further may provide a carton for enclosing a number of products. The carton may include a top panel, a pair of side panels, an end panel, and a removable portion. The removable portion may form a pair of corner posts. Each of the corner posts may be defined by a portion of the top panel, the side panels, and the end panel.

The corner posts may include a rectangular shape along the top panel. The corner posts may include a length on the top panel along the first and the second side panels of about 1.0 centimeter and a length on the top panel along the end panel of about 1.0 centimeter. The corner posts may include a length into the first and the second side panel of about 8.3 centimeters and a length into the end panel of about eight (8) centimeters. The removable portion may include one or more finger cut outs formed therein. The end panel may include a number of tabs.

The present invention further may provide a carton. The carton may include a top enclosure, a pair of side enclosures, an end enclosure, and a number of score lines extending along the top enclosure, the pair of side enclosures, and the end enclosure. The score lines may define a pair of corner posts extending along the top enclosure, the pair of side enclosures, and the end enclosure.

The present invention further may provide a container. The container may include a top panel, a pair of side panels, an end panel, and dispenser means positioned along the top panel, the pair of side panels, and the end panel. The dispenser means may include a pair of corner posts formed therein.

These and other features of the present invention will become apparent upon review of the following detailed description when taken in conjunction with the drawings and the appended claims.

DETAILED DESCRIPTION

Figure 1:
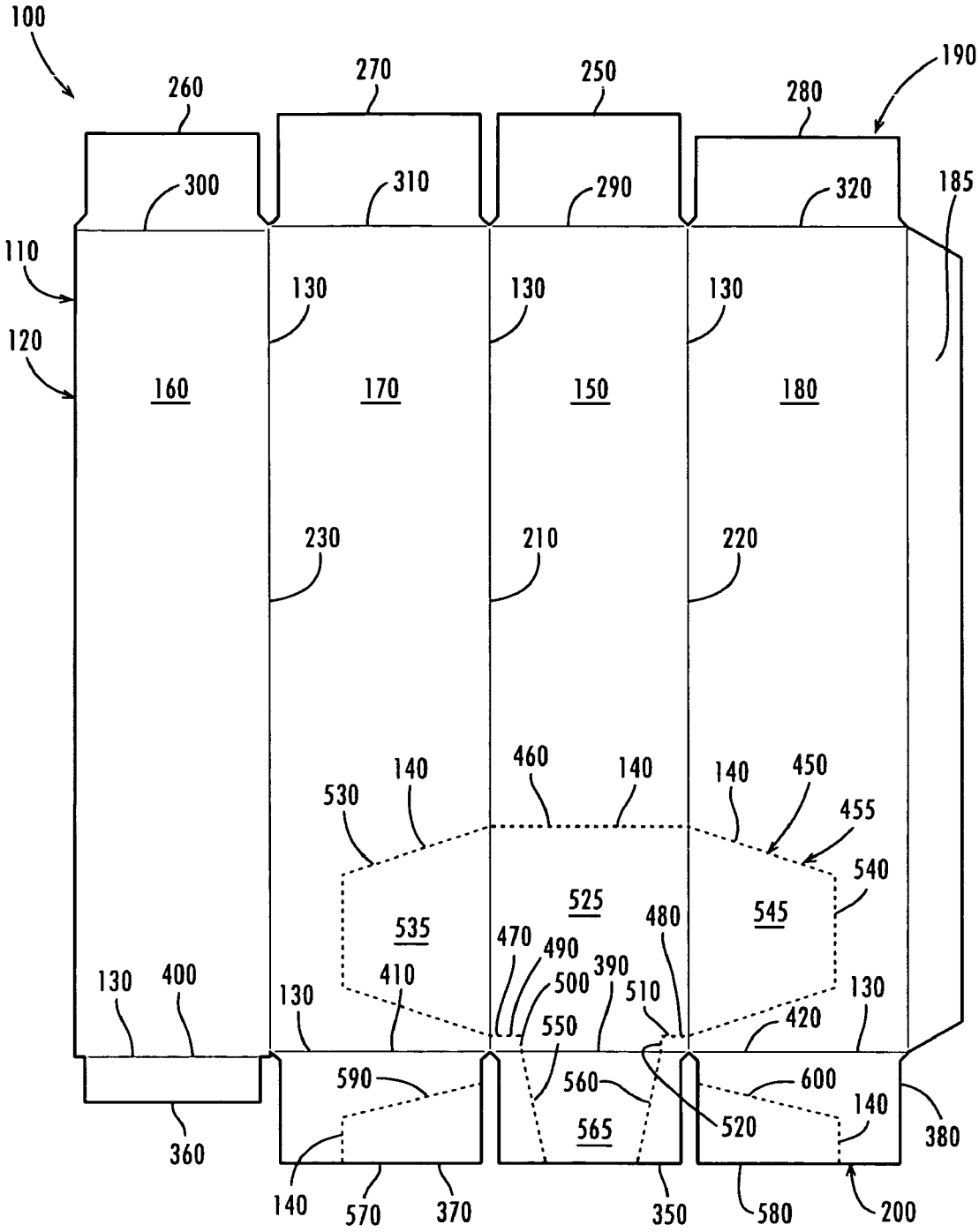
FIG. 1 is a plan view of a blank showing an embodiment of a carton of the present invention.

Referring now to the drawings, in which like numerals indicate like elements throughout the several views, FIGS. 1 through 5 show an embodiment of a carton 100 of the present invention. For example, FIG. 1 shows a blank 110 from which the carton 100 may be assembled. The blank 110 may be die cut from a continuous sheet of a material 120. The blank 110 may be made out of cardboard, paperboard, corrugated board, or similar types of materials 120. Preferably, the material 120 may be recyclable. The material 120 may have graphics printed thereon.

The blank 110 may have a number of fold lines 130 and score lines 140 pre-formed therein. The fold lines 130 may form the elongated side, the top, and the bottom panels as well as the first and the second ends. Specifically, the carton 100 may have a top panel 150, a bottom panel 160, a first side panel 170, a second side panel 180, a first end 190, and a second end 200. A tab 185 that extends from the second side panel 180 may complete the carton 110.

The top panel 150 and the first side panel 170 may be divided by a first top fold line 210. The top panel 150 may be separated from the second side panel 180 by a second top fold line 220. The bottom panel 160 may be separated from the first side panel 170 by a first bottom fold line 230. The tab 185 may be separated from the second side panel 180 via a second bottom fold line 240. When each of the fold lines 210, 220, 230, 240 are folded, the carton 100 takes on a largely hollow rectangular shape. The tab 185 may be glued to the bottom panel 160 via conventional adhesives or other types of joinder means. The top panel 150 and the bottom panel 160 may have a width of about 12.2 centimeters. The first side panel 170 and the second side panel 180 may have a width of about 12.8 centimeters. Each of the panels 150, 160, 170, 180 may have length of about 39.5 centimeters. Any desired size or shape, however, may be used.

The first end 190 of the carton 100 may be formed by a number of tabs extending from each of the panels 150, 160, 170, 180. Specifically, a top panel tab 250, a bottom panel tab 260, a first side panel tab 270, and a second side panel tab 280. The bottom panel tab 260 and the second side panel tab 280 may be somewhat shorter in length than the top panel 250 and the first side panel tab 270 for ease in folding and closing. Specifically, the top panel tab 250 and the first side panel tab 270 may be about six (6) centimeters in length and the bottom panel tab 260 and the second side panel tab 280 may be about 4.5 centimeters in length. Any desired size or shape, however, may be used. Each of the tabs 250, 260, 270, 280 may be somewhat smaller in width than its accompanying panel 150, 160, 170, 180 for ease in folding.

The top panel tab 250 may be separated from the top panel 150 by a top panel tab fold line 290. The bottom panel 260 may be separated from the bottom panel 160 by a bottom panel tab fold line 300. The first side panel tab 270 may be separated from the first side panel 170 by a first side panel tab fold line 310. The second side panel tab 280 may be separated from the second side panel 180 by a second side panel tab fold line 320.

To close the first end 190, the tabs 250, 260, 270, 280 may be folded along the fold lines 290, 300, 310, 320. The side panel tabs 270, 280 may be attached to the top panel tab 250 and the bottom panel tab 260 via adhesives or other types of joinder means. The respective sizes of the tabs 250, 260, 270, 280 may be varied. Likewise, the order of closing the tabs 250, 260, 270, 280 may be varied.

The second end 200 of the carton 100 may be similarly constructed. The second end 200 may be formed by a number of tabs extending from each of the panels 150, 160, 170, 180. Specifically, a top panel tab 350, a bottom panel tab 360, a first side panel tab 370, and a second side panel tab 380. The bottom panel tab 360 may be somewhat shorter in length than the top panel 350, the first side panel tab 370, and the second side panel tab 380 for ease in folding and closing. Specifically, the top panel tab 350, the first side panel tab 370, and the second side panel tab 380 may be about six (6) centimeters in length while the bottom panel tab 360 may be about four (4) centimeters in length. Any desired size or shape, however, may be used. Each of the tabs 350, 360, 370, 380 may be somewhat smaller in width than its accompanying panel 150, 160, 170, 180 for ease in folding.

The top panel tab 350 may be separated from the top panel 150 by a top panel tab fold line 390. The bottom panel tab 360 may be separated from the bottom panel 160 by a bottom panel tab fold line 400. The first side panel tab 370 may be separated from the first side panel 170 by a first side panel tab fold line 410. The second side panel tab 380 may be separated from the second side panel 180 by a second side panel tab fold line 420.

To close the second end 200, the tabs 350, 360, 370, 380 may be folded along the fold lines 390, 400, 410, 420. The side panel tabs 370, 380 may be attached to the top panel tab 350 and the bottom panel tab 360 via adhesives or other types of joinder means. The respective sizes of the tabs 350, 360, 370, 380 may be varied. Likewise, the order of closing the tabs 350, 360, 370, 380 may be varied.

The carton 100 also may contain a dispenser 450. The dispenser 450 may be formed by a number of the score lines 140 running along several of the panels and tabs to form a removable portion 455. The dispenser 450 may include a top panel score line 460 that may run the width of the top panel 150. The top panel score line 460 may be positioned towards the second end 200 of the carton 100. In this example, the top panel score line 460 may be about ten (10) centimeters from the top panel tab fold line 390 of the second end 200. Any desired dimensions, however, may be used. Although the dispenser 450 is described as being positioned on the second end 200 of the carton 100, the dispenser 450 could be located at the first end 190 or at both ends 190, 200.

The top panel 150 also may include two corner posts, a first corner post 470 and a second corner post 480. Each corner post 470, 480 may be substantially square or rectangular in shape, although other shapes may be used. The first corner post 470 may be defined by the first top fold line 210 and the top panel tab fold line 390 on two sides and by a horizontal first corner post score line 490 and a vertical first corner post score line 500. (The terms "horizontal" and "vertical" are used merely for reference as opposed to an actual orientation.) Likewise, the second corner post 480 may be defined by the second top fold line 220 and the top panel tab fold line 390 on two sides and a horizontal second corner post score line 510 and a vertical second corner post score line 520. The horizontal corner post score lines 490, 510 and the vertical corner post score line 500, 520 may be about 0.5 to about 1.5 centimeters in length. Any desired size or shape, however, may be used. The top panel score line 460 and the corner posts 470, 480 define a top panel removable portion 525.

The removable portion 455 of the dispenser 450 also may extend into the first side panel 170 and the second side panel 180. The first side panel 170 may have a first side score line 530 while the second side 180 has a second side score line 540. The side score lines 530, 540, in this embodiment, may be largely in a squared "U" shape. The side score lines 530, 540 may extend from the first top panel score line 460 downward on both side panels 170, 180 at an angle of about one hundred to about one hundred twenty degrees off the horizontal for a length of about 8.3 centimeters in length. The side score lines 530, 540 then may extend in a largely horizontal direction for about 6 centimeters until they again rise to towards the top panel 150 and the corner posts 470, 480 at a similar angle. Any desired dimension and angle, however, may be used. The side score lines 530, 540 may form a first side panel removable portion 535 and a second side panel removable portion 545.

The removable portion 455 of the dispenser 450 also may continue into the top panel tab 350 of the second end 200. The removable portion 455 may be defined by a first top panel tab score line 550 and a second top panel tab score line 560. Both tab score lines 550, 560 may extend from the corner posts 470, 480 completely through the top panel tab 350. The first top panel tab score line 550 may extend at an angle from the horizontal of about one hundred to about one hundred twenty degrees. The second top panel tab score line 560 may be the mirror opposite. The top panel tab score lines 550, 560 may be about six (6) centimeters in length. Any desired size or shape, however, may be used. The top panel tab score lines 550, 560 may form a top panel tab removable portion 565.

The side panel tabs 370, 380 also may have a cutout portion or removable portion, a first side panel tab removable portion 570 and a second side panel tab removable portion 580. A first side panel score line 590 and a second side panel tab score line 600 may form the removable portions 570, 580. The side panel tab score lines 590, 600 may be largely "L" in shape so as to conform to the score lines 550, 560 of the top panel tab 350. The side panel tab score lines 590, 600 may extend from about 4.5 centimeters from the end of each of the tabs 370, 380 in a largely vertical direction for about three (3) centimeters and then extend at an angle towards the side panel tab fold lines 410, 420 at a distance of about 7.9 centimeters. The angle may be about one hundred to about one hundred twenty degrees. Any desired dimension or angle, however, may be used herein.

Figure 2:
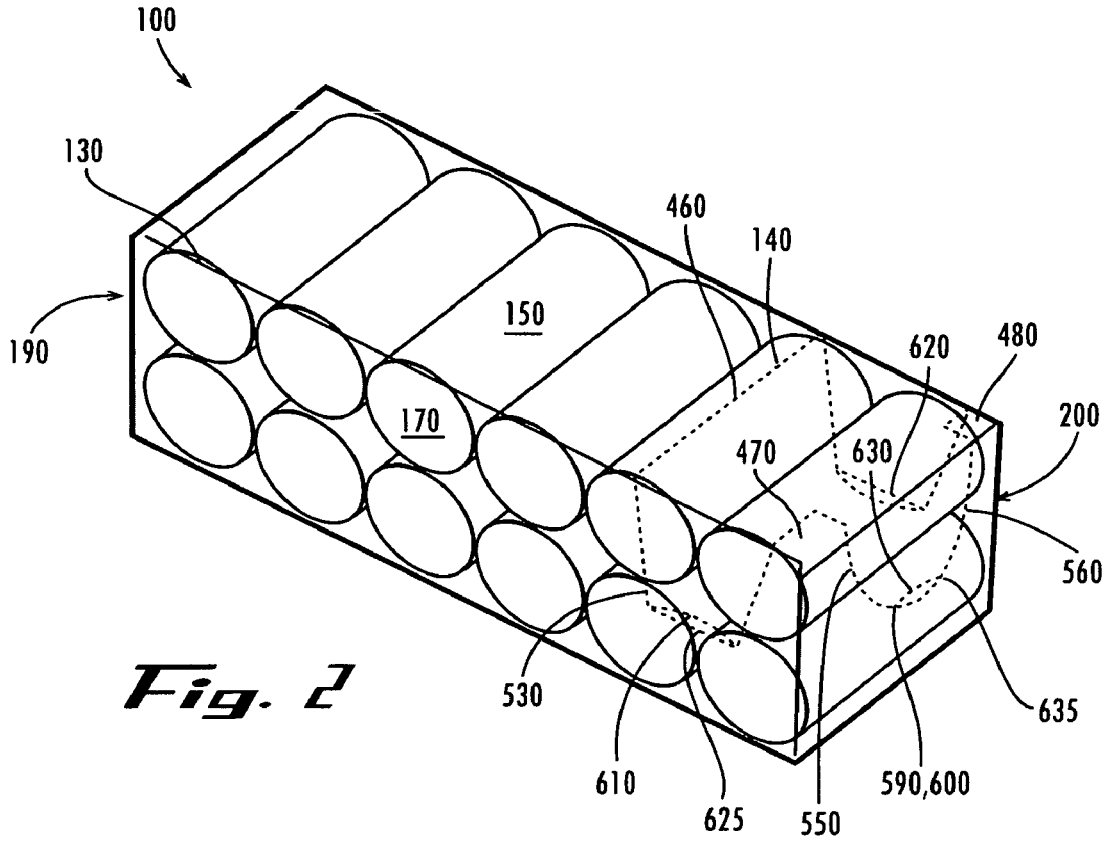
FIG. 2 is a perspective view of a transparent carton constructed according to the blank of FIG. 1 and showing the products therein.
Figure 3:
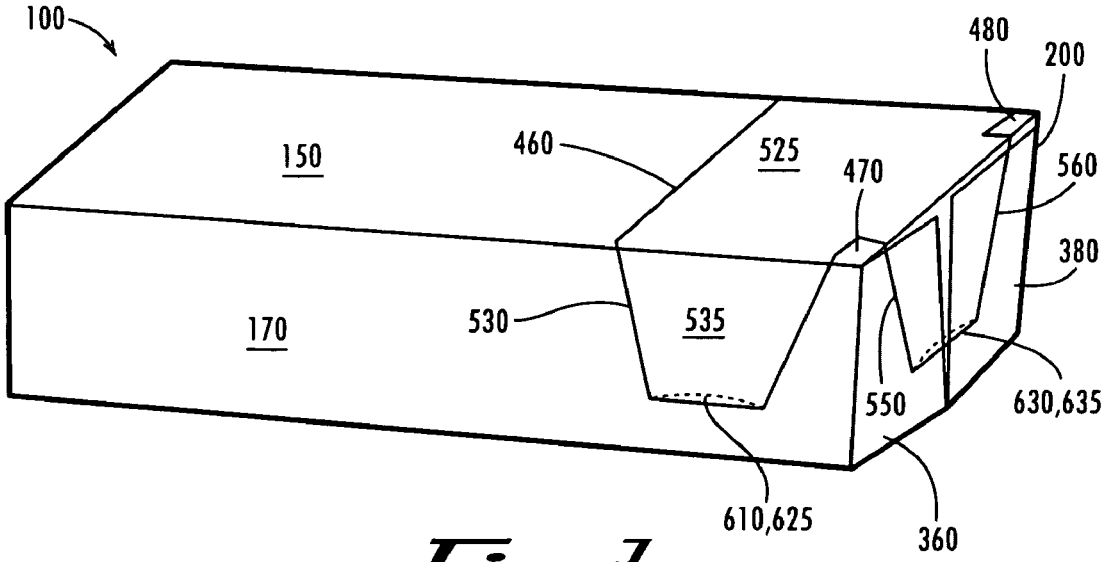
FIG. 3 is a perspective view of a carton constructed according to the blank of FIG. 1.
Figure 4:
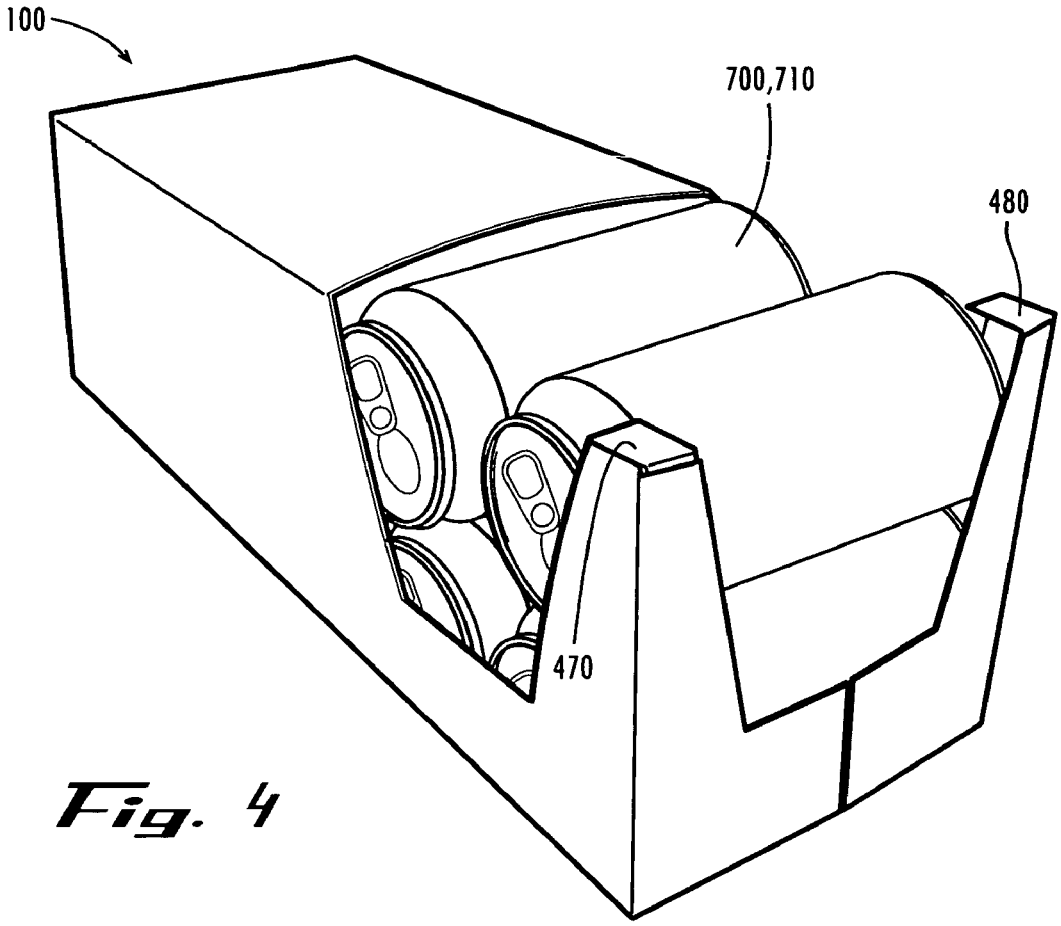
FIG. 4 is a perspective view of the carton of FIG. 3 with the dispenser removed.
Figure 5:
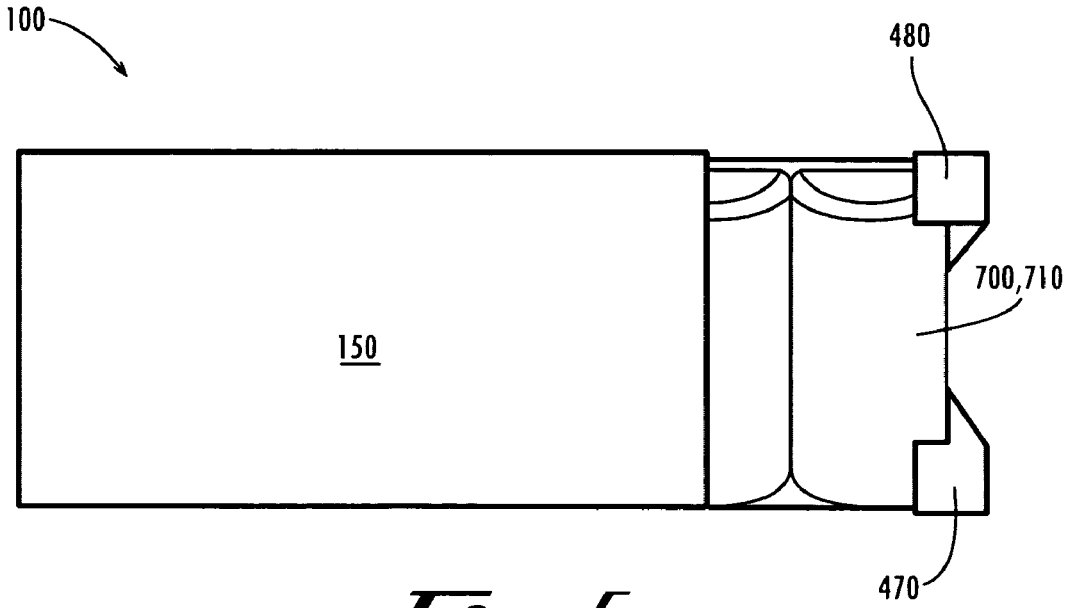
FIG. 5 is a top plan view of the carton of FIG. 3 with the dispenser removed.

As is shown in FIGS. 2 and 3, the first side panel removable portion 535 and the second side panel removable portion 545 of the dispenser 450 may have an additional first side panel score line 610 and an additional second side panel score line 620. The additional score lines 610, 620 may extend from the side score lines 530, 540 and form a finger cut out 625. Likewise, the side panel tabs 370, 380 also may have an additional side panel score line 630. The additional side panel score line 630 may extend from the first side panel tab score line 590 and the second side panel tab score line 600 of the side panel tabs 370, 380 and also form a finger cut out 635. A similar score line may be positioned along the top panel tab 350. These finger cut outs 625, 635 allow for consumer to insert his/her finger therein so as to begin removal of the removable portion 455. An additional finger cut out may be added about top panel score line 460 if desired.

In use, the carton 100 may be formed by the blank 110 being cut from the continuous length of the material 120. The fold lines 130 and the score lines 140 of the dispenser 450 may be imprinted within the blank 410. The carton 100 then may be erected along the fold lines 130, specifically, the first top fold line 210, the second top fold line 220, the first bottom fold line 230, and the second bottom fold line 240. The bottom tab 185 then may be glued or otherwise attached to the bottom panel 160 to form a largely rectangular tube. The first or the second end 190, 200 then may be enclosed along the top panel tab fold lines 290, 390, the bottom panel tab fold lines 300, 400, the first side panel tab fold lines 310, 410, and the second side panel tab fold lines 320, 420. The tabs then may be glued or otherwise attached and enclosed. A number of products 700 may be inserted within the carton 100. In this example, the products 700 may be a number of cans 710. Bottles or any other type of products 700 also may be used herein. The remaining end 190, 200 of the carton 100 then may be enclosed. The carton 100 then may be transported to the consumer.

The removable portion 455 of the dispenser 450 may be removed along the score lines 140 by beginning with the finger cut outs 625 on the side panels 170, 180 and/or the finger cut outs 635 along the side panel tabs 370, 380. Other finger cut outs also may be used. The first side panel removable portion 535 and the second side panel removable portion 545 may be torn along the first and second side panels 170, 180 and continue into the top panel removable portion 525. Likewise, the top panel tab removable portion 565, the first side panel tab removable portion 570, and the second side panel tab removable portion 580 may be removed from the panel tabs 350, 370, 380. The entire removable portion 455 then may be discarded.

Once the removable portion 455 is removed, the first corner post 470 and the second corner post 480 remain along the top panel 150, the side panels 170, 180, and the tabs 350, 370, 380. The corner posts 470, 480 enclose the products 700 in three (3) dimensions so as to allow the products 700 to remain firmly in place within the carton 100 in almost any orientation. The corner posts 470, 480 also add structural strength to the carton 100 as a whole. As a result, the cartons 100 have improved stackability.

Although the carton 100 has been described in the context of a two (2) row and six (6) column format, any size or shape may be used herein. The nature of the dispenser 450 does not depend on the overall configuration of the carton 100. Likewise, although certain specific dimensions have been used herein, any size or shape may be used.

It should be understood that the foregoing relates only to the exemplary embodiments of the present invention and that numerous changes and modifications may be made herein without departing from the general spirit and scope of the invention as defined by the following claims and the equivalents thereof.

The invention claimed is:

1. A carton for enclosing a number of products, comprising:

a top panel;

a first side panel positioned adjacent to the top panel;

a second side panel positioned adjacent to the top panel;

a top panel tab positioned adjacent to the top panel and separated from the top panel by a top panel fold line;

a first score line extending across the top panel from the first side panel to the second side panel; and a pair of second score lines extending across the top panel from the first side panel and the second side panel respectively to the top panel fold line, thus forming a first and a second corner flap along the top panel;

wherein the top panel tab comprises a pair of top panel tab score lines extending across the top panel tab from the pair of second score lines;

wherein the first side panel comprises a first side panel tab and wherein the second side panel comprises a second side panel tab;

wherein the first side panel tab comprises a first side panel tab score line and wherein the second side panel tab comprises a second side panel tab score line; and wherein the first side panel tab score line aligns with a first of the pair of top panel tab score lines and the second side panel tab score line aligns with a second of the pair of top panel tab score lines.

2. The carton of claim 1, wherein the top panel and the first side panel are separated by a first top panel fold line and wherein the top panel and the second side panel are separated by a second top panel fold line.

3. The carton of claim 1, wherein the first side panel comprises a first side panel score line extending from the first score line to a first of the pair of second score lines.

4. The carton of claim 3, wherein the second side panel comprises a second side panel score line extending from the first score line to a second of the pair of second score lines.

5. The carton of claim 4, wherein the first side panel score line and the second side panel score line each comprise a substantially squared "U" shape.

6. The carton of claim 1, wherein the top panel comprises a finger cut out formed therein.

7. The carton of claim 1, wherein the first side panel tab and the second side panel tab each comprise a finger cut out formed therein.

8. The carton of claim 1, wherein the first corner flap and the second corner flap each comprise a rectangle.

9. The carton of claim 1, wherein the carton is formed from a blank, each of the fold lines and the score lines being imprinted within the blank.

10. The carton of claim 1, wherein the carton is formed from a material that is one or more of cardboard, paperboard, and corrugated board.

11. The carton of claim 1, further comprising an additional tab that extends from the second side panel, the additional tab being separated from the second side panel by a second bottom fold line.

12. The carton of claim 1, further comprising a bottom panel positioned adjacent the first side panel, the bottom panel being separated from the first side panel by a first bottom fold line.

13. The carton of claim 12, wherein:

the top panel and the bottom panel each have a width of about 12.2 centimeters and a length of about 39.5 centimeters; and the first side panel and the second side panel each have a width of about 12.8 centimeters and a length of about 39.5 centimeters.

14. The carton of claim 12, wherein the carton is configured to form a relatively hollow rectangular shape when each of the fold lines are folded.

15. The carton of claim 12, wherein:

each panel comprises a first edge and a second edge; and the carton further comprises a number of tabs, each panel having one tab extending from the first edge of the panel and one tab extending from the second edge of the panel, each tab being separated from the corresponding panel by corresponding fold line, the tabs including the top panel tab, the top panel tab extending from the second edge of the top panel and being separated from the top panel by the top panel fold line.

16. The carton of claim 4, wherein a removable portion is defined by at least some of the score lines, the removable portion being removed from the carton to form a dispenser in the carton.

17. The carton of claim 16, wherein a pair of corner posts are defined by at least some of the score lines and fold lines, the corner posts remaining on corners of the carton after the removable portion is removed, the corner posts enclosing an interior of the carton in three-dimensions so that products can be retained within the interior of the carton.

18. The carton of claim 1, wherein a removable portion is defined by at least some of the score lines, the removable portion being removed from the carton to form a dispenser in the carton.

19. The carton of claim 18, wherein a pair of corner posts are defined by at least some of the score lines and fold lines, the corner posts remaining on corners of the carton after the removable portion is removed.

20. The carton of claim 19, wherein each corner post includes one of the corner flaps along the top panel.

21. The carton of claim 19, wherein the corner posts enclose an interior of the carton in three-dimensions, so that products can be retained on the interior of the carton.

* * * * *